US011160727B2

(12) United States Patent
Flygare et al.

(10) Patent No.: US 11,160,727 B2
(45) Date of Patent: Nov. 2, 2021

(54) LOCKABLE MEDICINE CONTAINER AND METHODS

(71) Applicant: Apothecary Products, LLC, Burnsville, MN (US)

(72) Inventors: Daniel Bruce Flygare, Chaska, MN (US); Daniel Darst, Zimmerman, MN (US)

(73) Assignee: Apothecary Products, LLC, Burnsville, MN (US)

( * ) Notice: Subject to any disclaimer, the term of this patent is extended or adjusted under 35 U.S.C. 154(b) by 208 days.

(21) Appl. No.: 16/394,945

(22) Filed: Apr. 25, 2019

(65) Prior Publication Data

US 2020/0337945 A1 Oct. 29, 2020

(51) Int. Cl.
*A61J 1/03* (2006.01)
*G07C 9/00* (2020.01)

(52) U.S. Cl.
CPC ..... *A61J 1/03* (2013.01); *G07C 9/00571* (2013.01); *A61J 2205/60* (2013.01)

(58) Field of Classification Search
CPC ..... A61J 1/03; G07C 9/00571
See application file for complete search history.

(56) References Cited

U.S. PATENT DOCUMENTS

| | | | |
|---|---|---|---|
| 1,885,547 | A | 11/1932 | Rider |
| 4,275,384 | A | 6/1981 | Hicks et al. |
| 4,572,403 | A | 2/1986 | Benaroya |
| 4,682,299 | A | 7/1987 | McIntosh et al. |
| 4,748,600 | A | 5/1988 | Urquhart |
| 4,768,176 | A | 8/1988 | Kehr et al. |
| 5,020,037 | A | 5/1991 | Raven |
| 5,099,463 | A | 3/1992 | Lloyd et al. |
| 5,181,189 | A | 1/1993 | Hafner |
| 5,200,891 | A | 4/1993 | Kehr et al. |

(Continued)

FOREIGN PATENT DOCUMENTS

| | | | |
|---|---|---|---|
| CA | 2251234 | A1 | 12/1998 |
| WO | 2011038419 | A1 | 3/2011 |
| WO | 2012098118 | A1 | 7/2012 |

OTHER PUBLICATIONS

International Search Report and Written Opinion for Application No. PCT/US2020/029137 dated Jul. 15, 2020, 18 pages.

*Primary Examiner* — Curtis B Odom
(74) *Attorney, Agent, or Firm* — Merchant & Gould P.C.

(57) ABSTRACT

A lockable medicine container includes a canister having a closed bottom end, an opposite top end defining an access opening, a surrounding wall between the bottom end and the access opening, and an interior volume within the surrounding wall. A radially inwardly extending ledge protrudes from the surrounding wall along at least a portion of a perimeter of the access opening. A lid is removably covering the access opening on the top end. A locking ring is rotatably and non-removably secured to the lid and is rotatable between a locked position and an unlocked position. The locked position is when the locking ring is engaged with the ledge to prevent removal of the lid from the canister. The unlocked position is when the locking ring is disengaged from the ledge to allow removal of the lid from the canister. A lock member is connected to the locking ring to permit selectively moving the locking ring between the locked position and unlocked position.

24 Claims, 20 Drawing Sheets

(56) References Cited

U.S. PATENT DOCUMENTS

| | | | |
|---|---|---|---|
| 5,289,157 | A | 2/1994 | Rudick et al. |
| 5,408,443 | A | 4/1995 | Weinberger |
| 5,751,661 | A | 5/1998 | Walters |
| 5,752,235 | A | 5/1998 | Kehr et al. |
| 5,850,937 | A | 12/1998 | Rauche |
| 5,915,558 | A | 6/1999 | Girvetz |
| 6,048,087 | A | 4/2000 | Laurent et al. |
| D457,819 | S | 5/2002 | Noble et al. |
| 6,449,218 | B1 | 9/2002 | Lluch |
| 6,771,174 | B2 | 8/2004 | Broas |
| 6,801,123 | B2 | 10/2004 | Brakus |
| 7,093,736 | B2 | 8/2006 | Maietta et al. |
| 7,545,257 | B2 | 6/2009 | Brue |
| 7,602,275 | B2 | 10/2009 | Dishongh et al. |
| 7,715,277 | B2 | 5/2010 | de la Huerga |
| 7,720,568 | B2 | 5/2010 | Berg et al. |
| 7,877,268 | B2 | 1/2011 | Kulkarni |
| 8,085,135 | B2 | 12/2011 | Cohen Alloro et al. |
| 8,174,370 | B1 | 5/2012 | Fulmer-Mason |
| 8,193,918 | B1 | 6/2012 | Shavelsky et al. |
| 8,214,077 | B2 | 7/2012 | Bertrand et al. |
| 8,581,709 | B2 | 11/2013 | Mazur |
| 8,749,359 | B1 | 6/2014 | Wilson |
| 8,752,728 | B2 | 6/2014 | Tignanelli et al. |
| 9,111,324 | B2 | 8/2015 | Hyde et al. |
| 9,144,399 | B2 | 9/2015 | Needham et al. |
| 9,268,913 | B2 | 2/2016 | Johnson et al. |
| 9,311,452 | B2 | 4/2016 | Dickie et al. |
| 9,393,180 | B2 | 7/2016 | Lapham |
| 9,504,628 | B2 | 11/2016 | Reddy et al. |
| 9,558,596 | B2 | 1/2017 | Nurse et al. |
| 9,588,496 | B2 | 3/2017 | Kodat |
| 9,603,776 | B2 | 3/2017 | Bunker et al. |
| 9,717,655 | B2 | 8/2017 | Nova et al. |
| 2002/0149472 | A1 | 10/2002 | Roe |
| 2007/0227913 | A1* | 10/2007 | Shoenfeld ..... G01K 1/022 206/1.5 |
| 2008/0006700 | A1 | 1/2008 | Zegelin et al. |
| 2010/0332023 | A1 | 12/2010 | Tripathi et al. |
| 2012/0152972 | A1* | 6/2012 | Joslyn ..... A61J 7/0076 221/3 |
| 2013/0062303 | A1* | 3/2013 | Serell ..... B23P 11/00 215/206 |
| 2016/0034669 | A1 | 2/2016 | Mahbubian |
| 2017/0281467 | A1* | 10/2017 | Solotoff ..... B65D 55/02 |

* cited by examiner

LOCKABLE MEDICINE CONTAINER AND METHODS

TECHNICAL FIELD

This disclosure relates to containers for medicine. In particular, this disclosure relates to lockable medicine containers and methods of use.

BACKGROUND

Prescription medications, including opioids and cannabis, can be subject to abuse. For example, family members or acquaintances of the patient who has been prescribed the medication may try to access the medication to use it for improper or illicit purposes. There is a need for providing security to the medication that is accessible only by the patient or by a trusted caregiver of the patient.

SUMMARY

In general, a lockable medicine container is provided that improves the prior art.

A lockable medicine container is provided including a canister having a closed bottom end, an opposite top end defining an access opening, a surrounding wall between the bottom end and the access opening, and an interior volume within the surrounding wall. A radially inwardly extending ledge protrudes from the surrounding wall along at least a portion of a perimeter of the access opening. A lid is removably covering the access opening on the top end. A locking ring is rotatably and non-removably secured to the lid and is rotatable between a locked position and an unlocked position. The locked position is when the locking ring is engaged with the ledge to prevent removal of the lid from the canister. The unlocked position is when the locking ring is disengaged from the ledge to allow removal of the lid from the canister. A lock member is connected to the locking ring to permit selectively moving the locking ring between the locked position and unlocked position.

In one embodiment, the ledge and the locking ring are members of a tab and slot arrangement, in which a first member defines one or more protruding tabs and a second member defines at least a same number of open slots as protruding tabs. Axial movement between the first and second member is blocked unless the one or more tabs are aligned with the open slots to allow the tabs to pass through the slots.

In some examples, the locking ring is the first member of the tab and slot arrangement, and the ledge is the second member of the tab and slot arrangement.

In some example embodiments, the lock member is a cam lock.

In some example embodiments, the lock member is a tubular key cam lock.

In some examples, the lid has a through hole, and the cam lock is non-removably held by the lid in the through hole.

In many implementations, the canister is cylinder-shaped.

In some embodiments, the canister includes a band forming the access opening, and the ledge protrudes radially inwardly from the band.

In some embodiments, the lock member includes a key pad with a circuit board and motor assembly, wherein when a correct code is entered into the key pad, the motor assembly rotates the locking ring.

In some implementations, there is a lid bottom holding the circuit board and border assembly between the locking ring and the lid.

In embodiments that have a keypad, the keypad may be held on an exterior portion of the lid.

In some arrangements, the lid includes a pair of spaced finger-engaging recesses, and the keypad is held in a region between the recesses.

In some arrangements, the lid has a round cross section, and the container has a generally rectangular cross section.

In some embodiments, the circuit board and motor assembly include a rechargeable battery, and the container contains a USB port in communication with the battery.

In another aspect, a lockable medicine container is provided. The container includes a canister having a closed bottom end, an opposite top end defining an access opening, is surrounding wall between the bottom and an access opening, and an interior volume within the surrounding wall along at least a portion of a perimeter of the access opening. A lid removably covers the access opening on the top end. A locking ring is rotatably and non-removably secured to the lid and is rotatable between a locked position and an unlocked position. The locked position is when the locking ring is engaged with the ledge to prevent removal of the lid from the canister. The unlocked position is when the locking ring is disengaged from the ledge to allow removal of the lid from the canister. The container further includes a means for locking to selectively move the locking ring between the locked position and the unlocked position.

In one embodiment, the means for locking is a cam lock.

In one embodiment, the means for locking is a keypad with a circuit board and motor assembly.

In some examples, the ledge and locking ring are members of a tab and slot arrangement, in which a first member defines one or more protruding tabs, and a second member defines at least a same number of open slots as protruding tabs. Axial movement between the first and second member is blocked unless the one or more tabs are aligned with the open slots to allow the tabs to pass through the slots.

In another aspect, a method for unlocking a medicine container is provided. The method includes providing a canister with an access opening and a lid removably covering the access opening. The lid is non-removably and rotatably secured to the locking ring. The method includes a step of rotating the locking ring from a locked position to an unlocked position. The locked position is when the locking ring is engaged with a ledge along a perimeter of the access opening to prevent removal of the lid from the canister. The unlocked position is when the locking ring is disengaged from the ledge to allow removal of the lid from the container.

The step of rotating the locking ring may include rotating a cam lock connected to the locking ring.

The step of rotating the locking ring may include using a motor assembly to rotate the locking ring.

The step of using a motor assembly may include entering a pre-selected code into a keypad connected to the circuit board and the motor assembly.

A variety of examples of desirable product features or method are set forth in the description that follows, and in part, will be apparent from the description, or may be learned by practicing various aspects of this disclosure. The aspects of this disclosure may relate to individual features, as well as combinations of features. It is to be understood that both the foregoing general description and the following detailed description are explanatory only, and are not restrictive of the claimed inventions.

DETAILED DESCRIPTION

Figure 1:
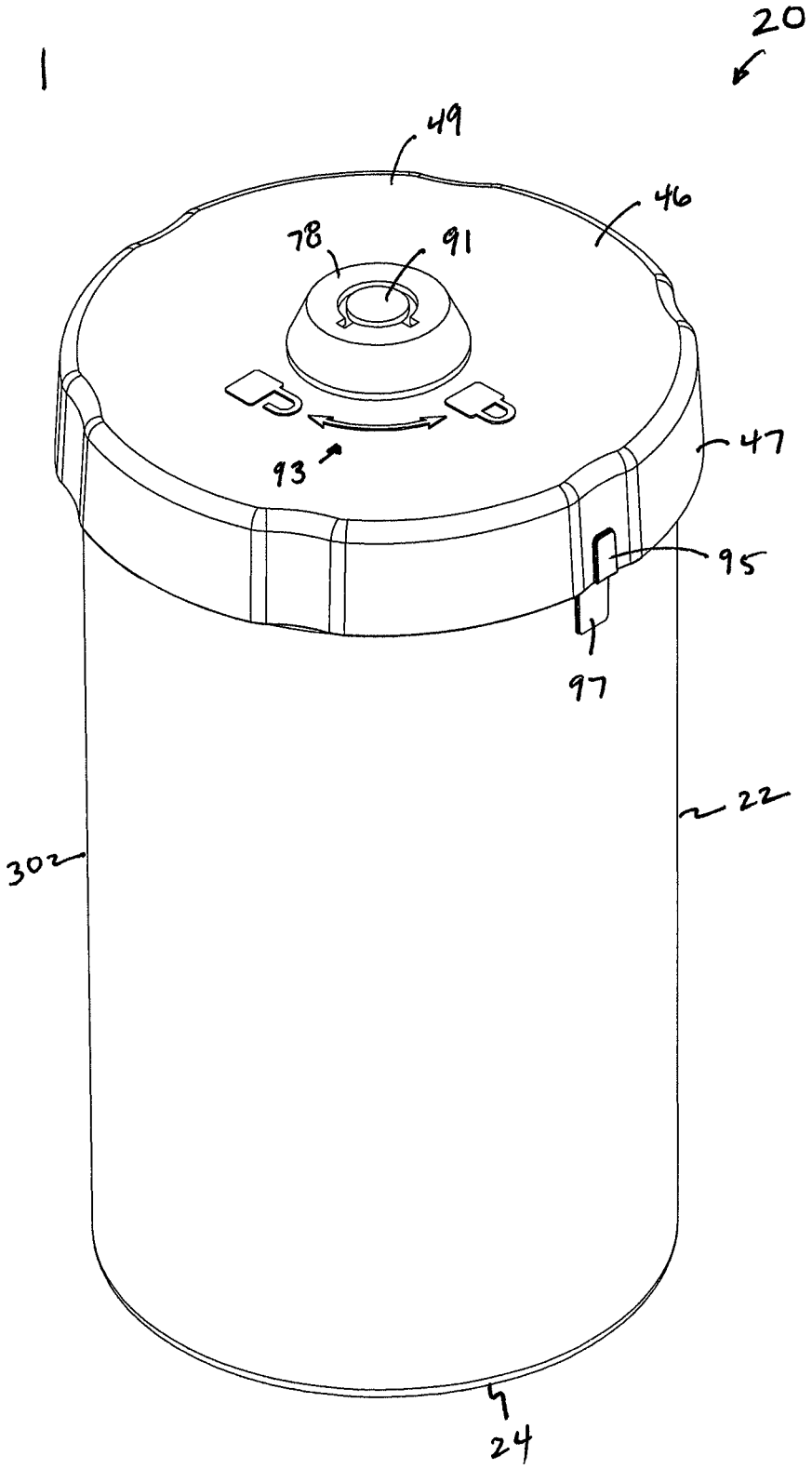
FIG. 1 is a perspective view of a lockable medicine container, according to a first embodiment, constructed in accordance with principles of this disclosure.
Figure 6:
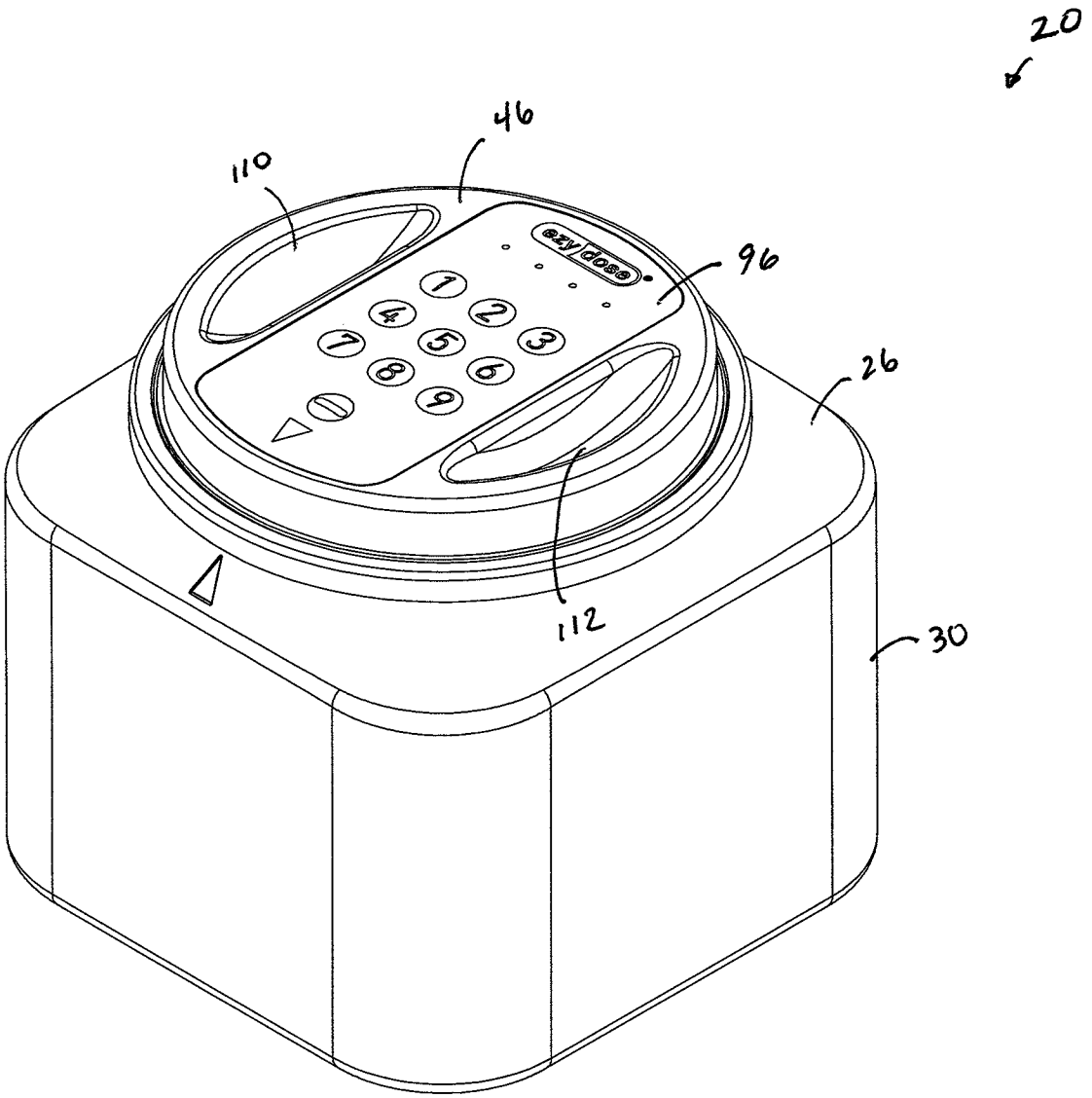
FIG. 6 is a perspective view of a second embodiment of a lockable medicine container, constructed in accordance with principles of this disclosure.
Figure 7:
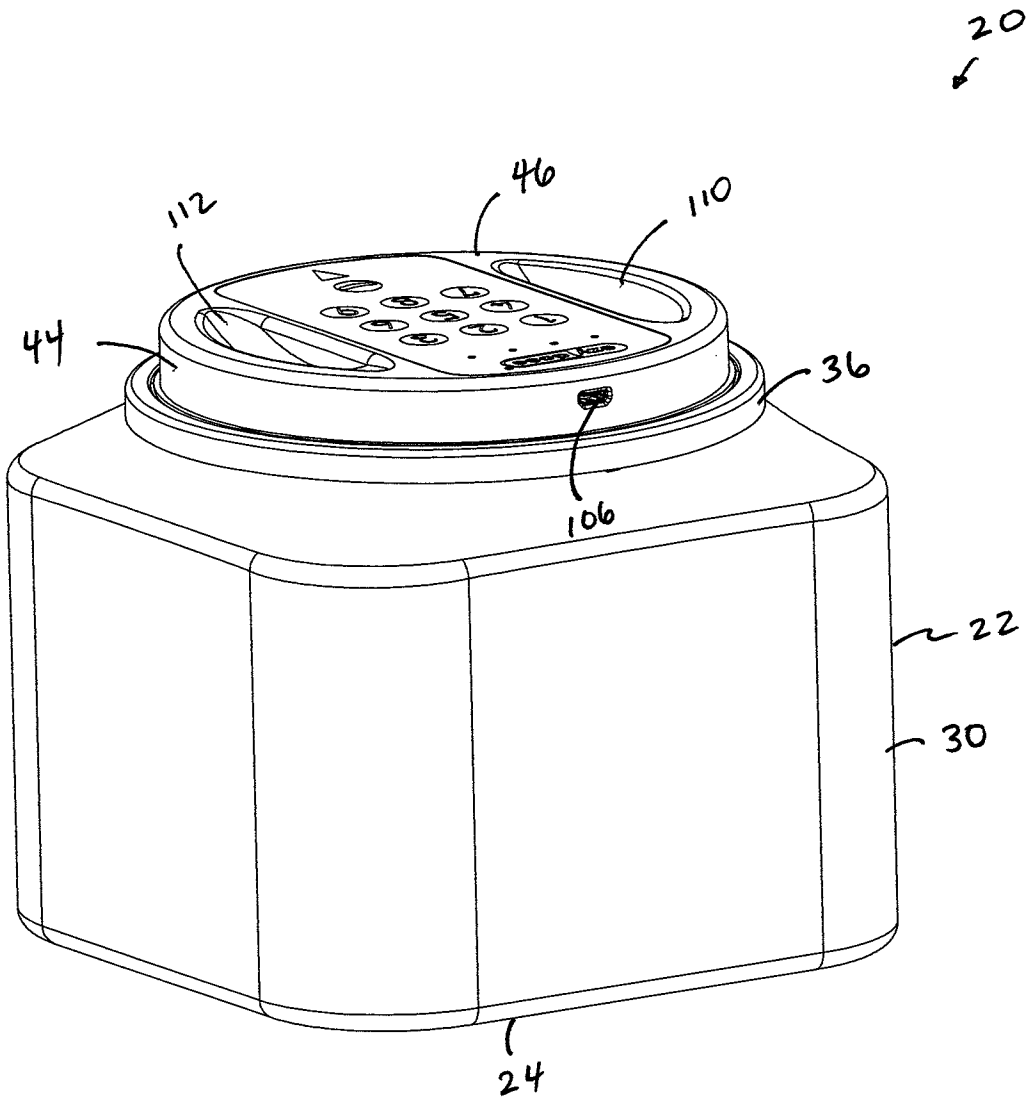
FIG. 7 is another perspective view of the container of FIG. 6.
Figure 19:
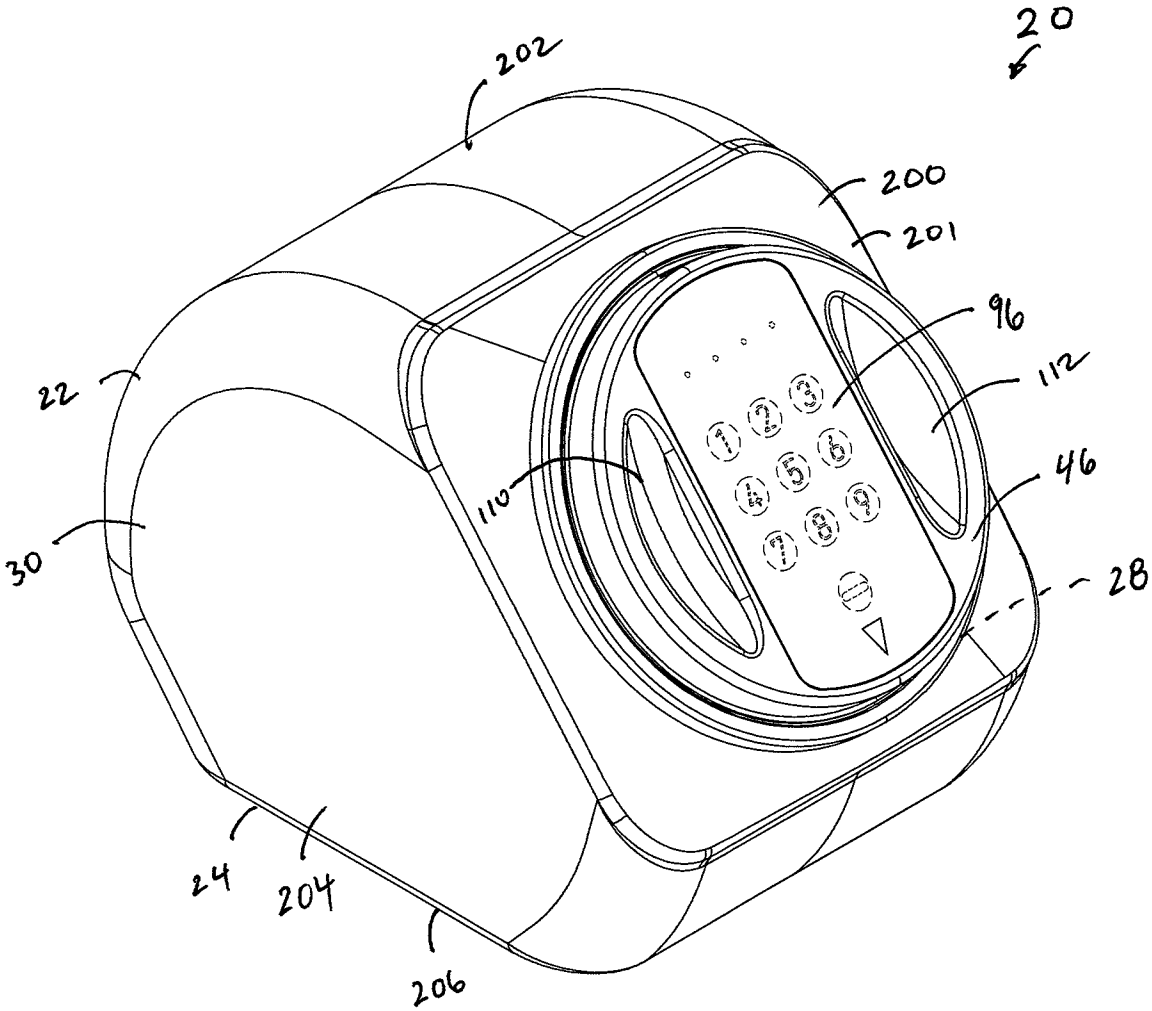
FIG. 19 is a perspective view of a third embodiment of a lockable medicine container, constructed in accordance with principles of this disclosure.

Referring to FIGS. 1, 6, and 19, three embodiments of a lockable medicine container are shown at reference numeral 20. While three different embodiments are shown, like parts will include the same reference numerals. It should be understood that many embodiments can be made according to the inventive principles, and these are just two examples.

In the embodiment of FIG. 1, the container 20 is generally cylinder-shaped. In the embodiment of FIG. 6, the container 20 is shaped as a rectangular box. In the FIG. 19 embodiment, the container 20 is "candy jar shaped", in that it has a rectangular face 200 at a top end 201, a rounded body 202, and a pair of planar sides 204, resting on a flat bottom 206.

The container 20 includes a canister 22. The canister 22 has a closed bottom end 24 and an opposite top end 26 defining an access opening 28. A surrounding wall 30 is between the bottom end 24 and the access opening 28. An interior volume 32 is contained within the surrounding wall 30.

In the embodiment of FIG. 1, the canister 22 is cylinder shaped, with the bottom end 24 and top end 26 being circular.

In the embodiment of FIG. 6, the canister 22 has a generally rectangular cross section. The bottom end 24 is rectangular, and the top end 26 is rectangular, while the access opening 28 is round or circular.

Figure 2:
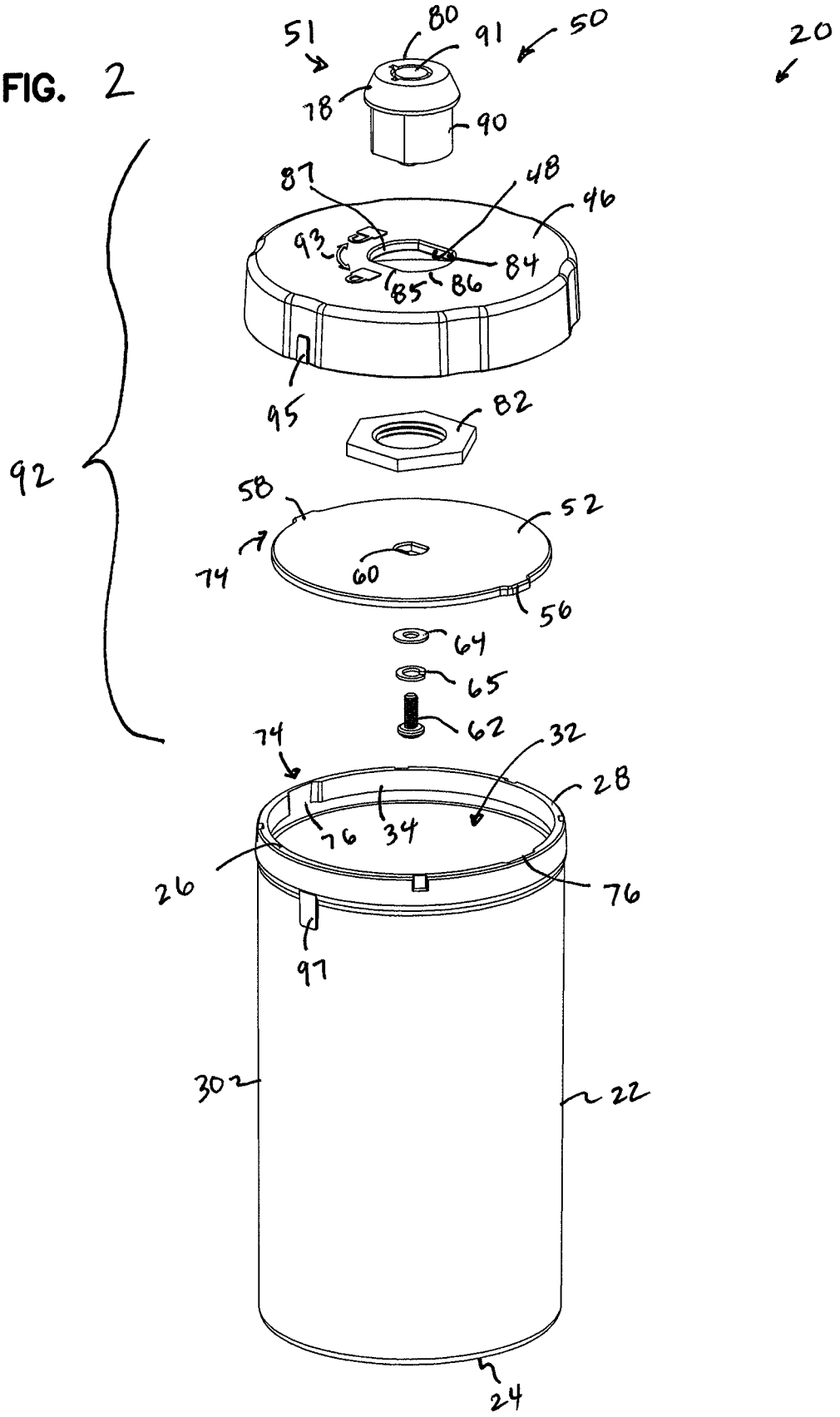
FIG. 2 is an exploded, perspective view of the container of FIG. 1.
Figure 3:
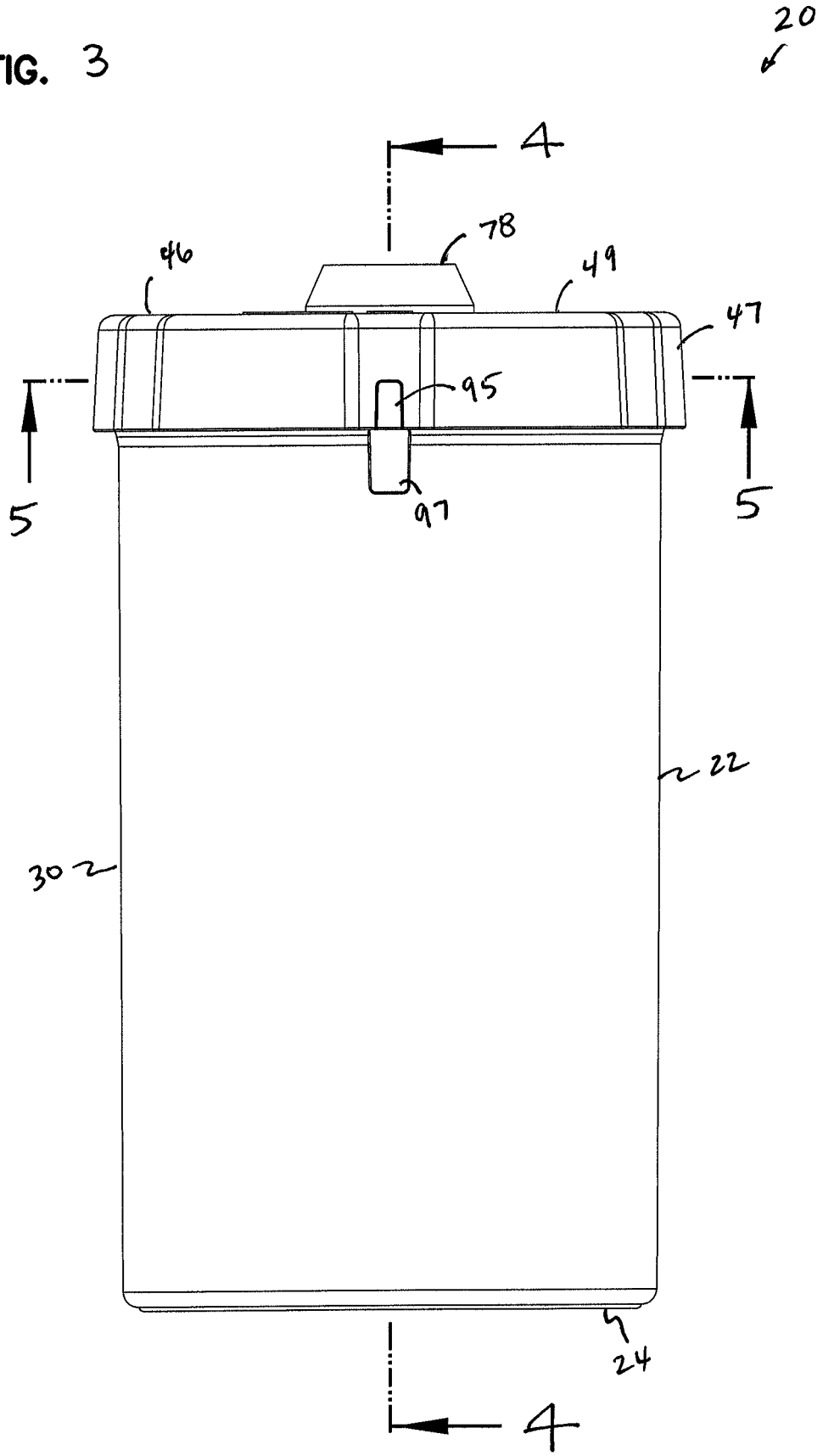
FIG. 3 is a front elevational view of the container of FIG. 1.
Figure 5:
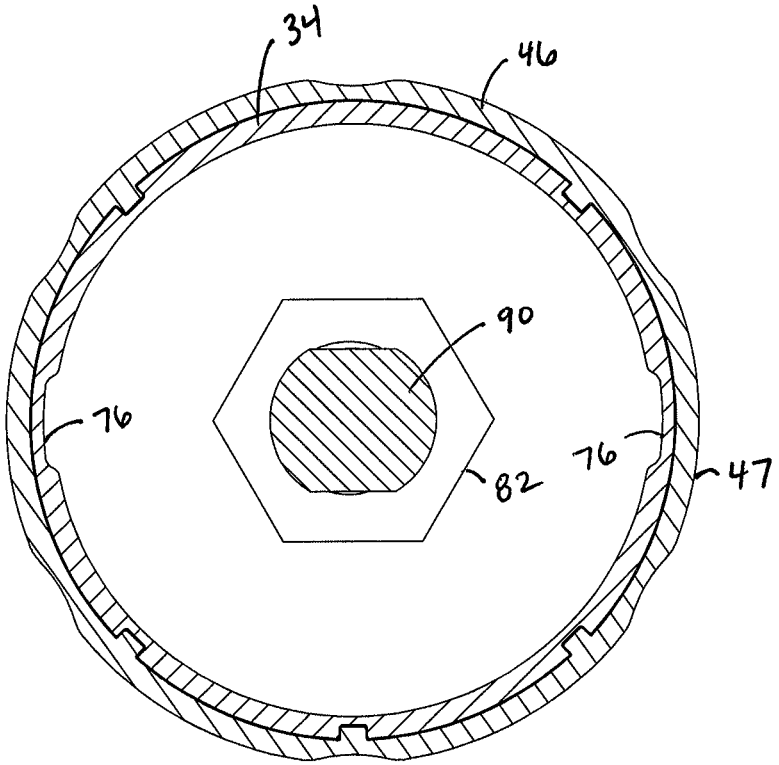
FIG. 5 is a cross-sectional view of the container of FIG. 1, the cross section being taken along the line 5-5 of FIG. 3.
Figure 13:
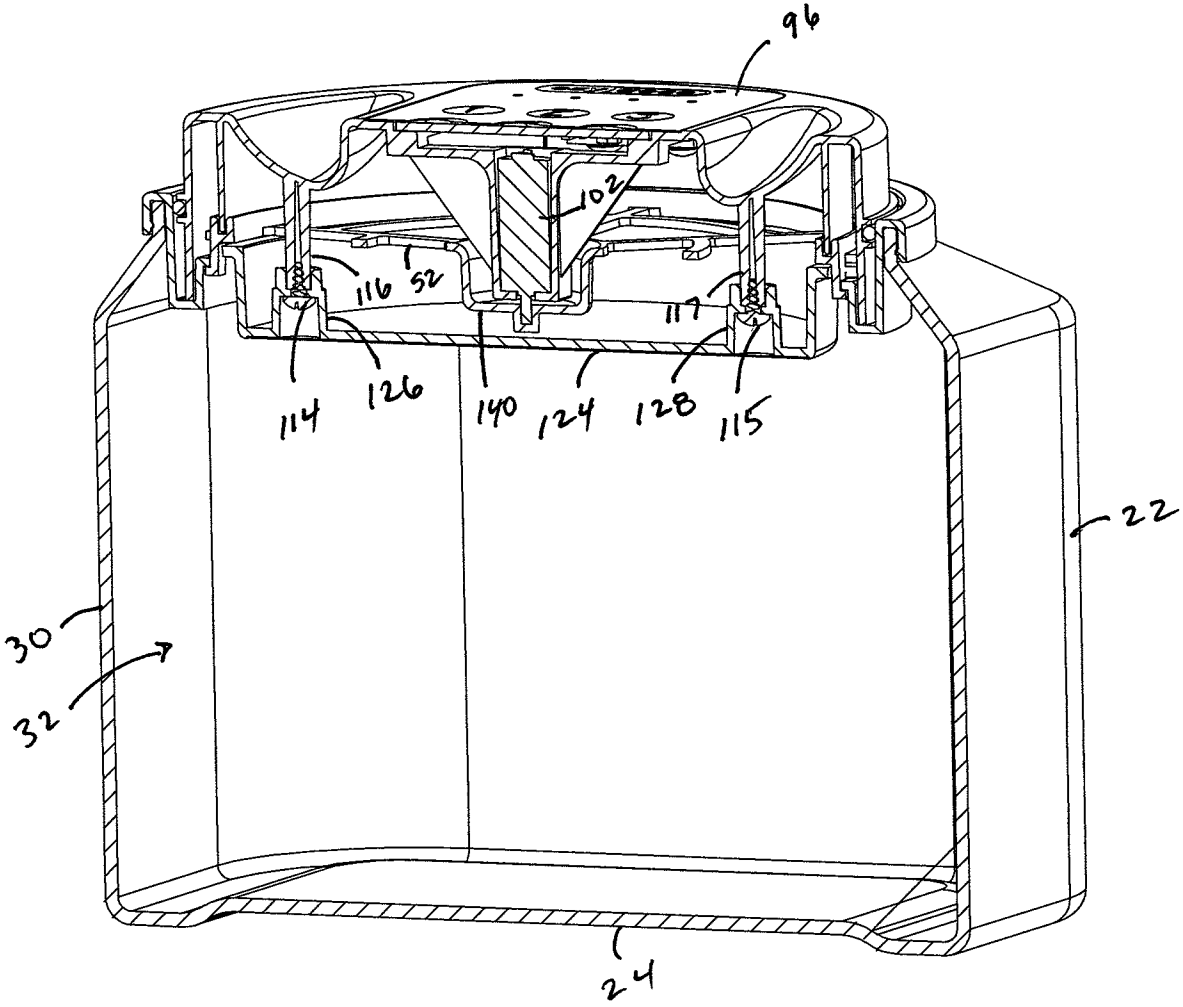
FIG. 13 is a cross-sectional view of the container of FIG. 6, the cross section being taken along the line 13-13 of FIG. 12.
Figure 14:
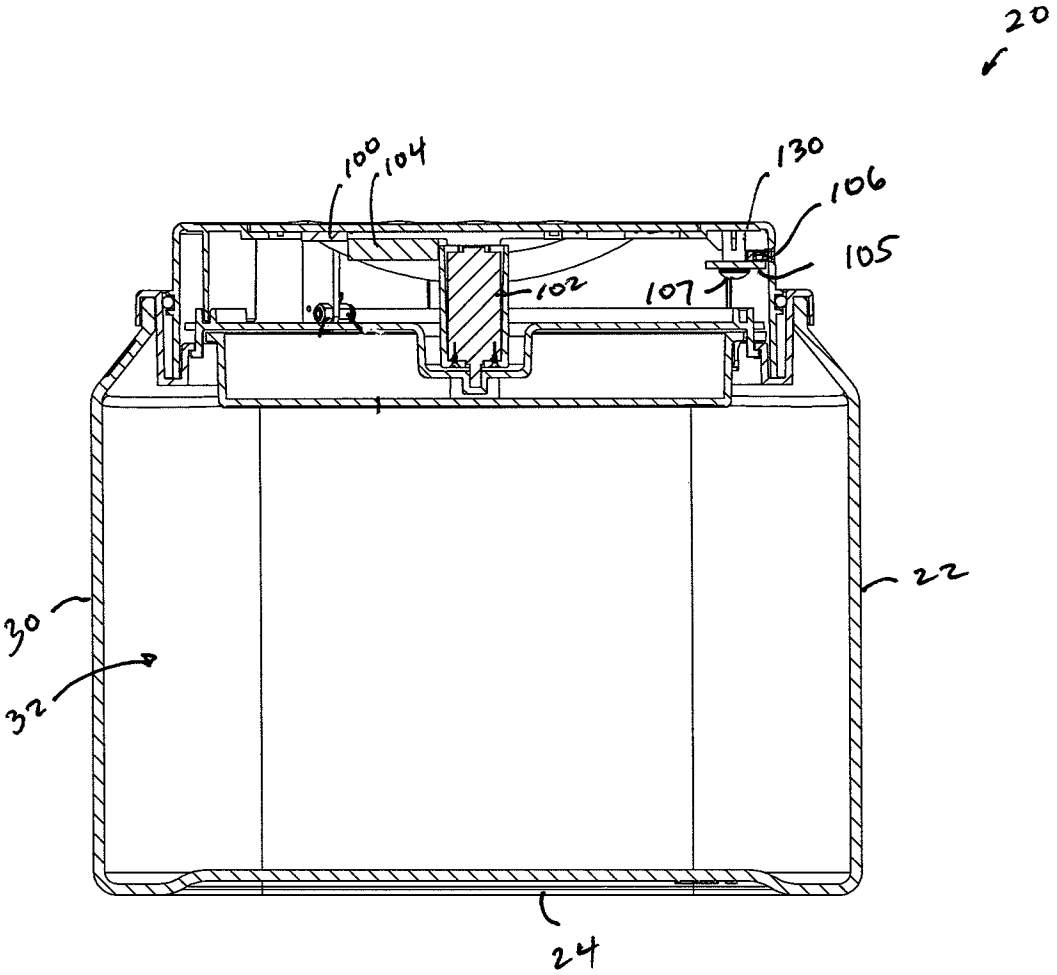
FIG. 14 is a cross-sectional view of the container of FIG. 6, the cross section being taken along the line 14-14 of FIG. 12.

The canister 22 includes a radially inwardly extending ledge 34 (FIGS. 2, 5, and 13). The radially inwardly extending ledge 34 protrudes from the surrounding wall 30 along at least a portion of a perimeter of the access opening 28. As will be appreciated from a further description, there is at least one opening or gap 76 along the ledge 34 to allow for passage of a locking tab.

Figure 8:
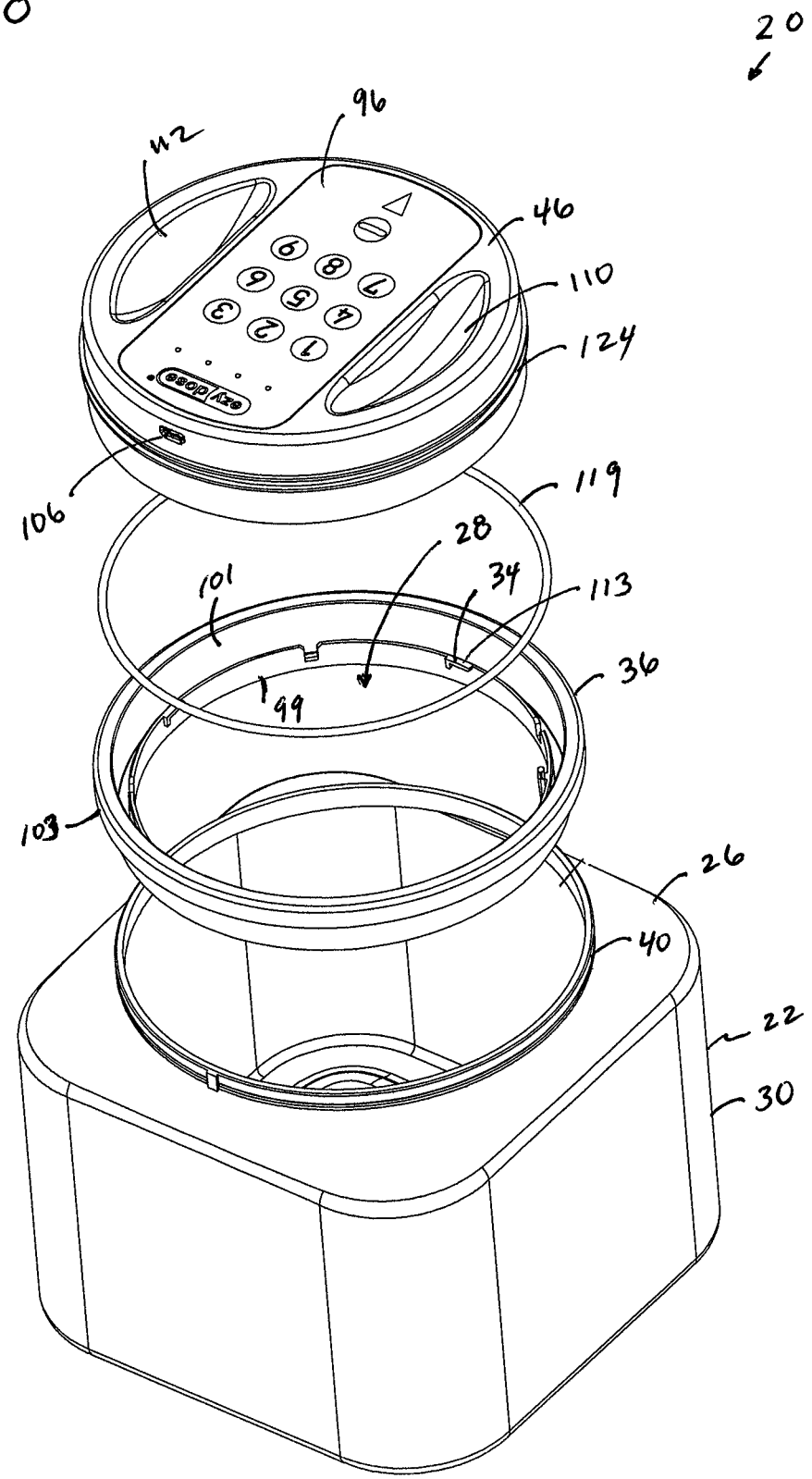
FIG. 8 is an exploded, perspective view of the container of FIG. 6.
Figure 15:
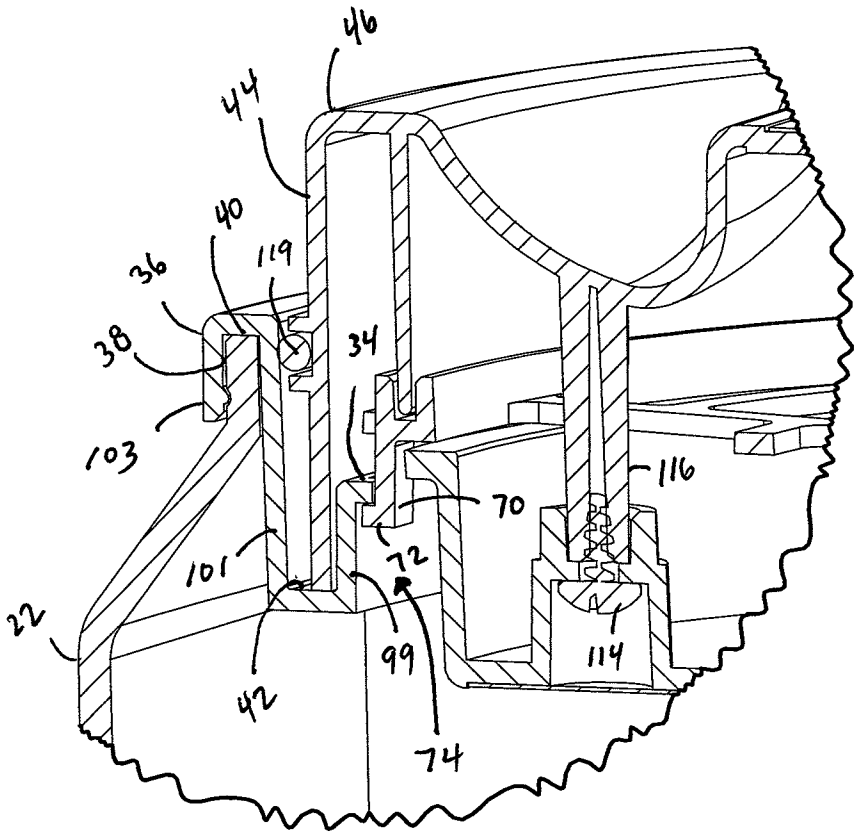
FIG. 15 is an enlarged view of a portion of FIG. 13.
Figure 17:
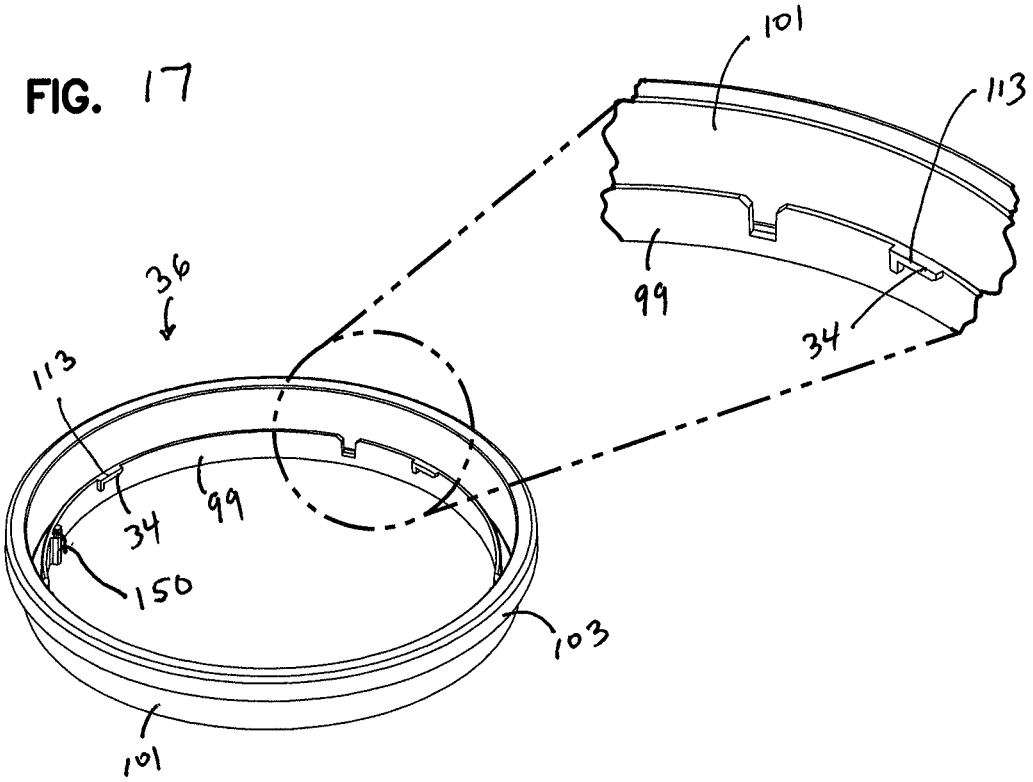
FIG. 17 is an enlarged, perspective view of a band, that forms part of the canister of the container of FIG. 6.
Figure 18:
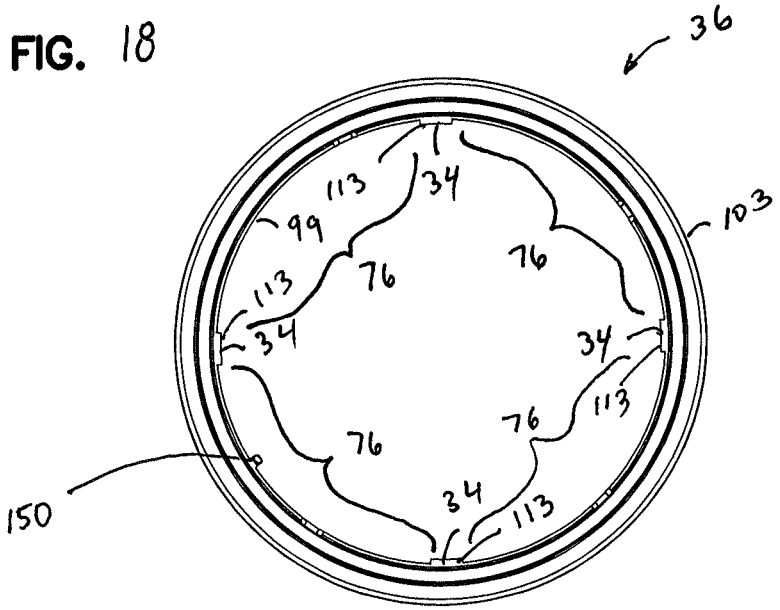
FIG. 18 is a top view of the band of FIG. 17.

In the embodiment of FIG. 6, the canister 22 includes a band 36 (FIG. 8). The band 36 is integral with the canister 22 and part of the canister 22, and it forms the access opening 28. In FIG. 15, the band 36 has outer perimeter wall 103. An upper groove 38 is defined between the outer perimeter wall 103 and band wall 101. The upper groove 38 receives an outer rim 40 (FIG. 8) of the surrounding wall 30. A lower portion of the band 36 defines an oppositely facing groove 42 and an inner wall 99. The groove 42 receives an outer wall 44 of a lid 46. The lid 46 removably covers the access opening 28 on the top end 26. In FIGS. 15, 17, and 18, it can be seen that the inner wall 99 of the band 36 defines an inner portion of the groove 42, with an outer portion of the groove 42 defined by band wall 101. The inner wall 99 of the band 36 includes ledge 34 protruding therefrom. Many variations in the band construction are possible, and this is only one non-limiting example.

In the FIG. 6 example, the ledge 34 is formed by a plurality of fingers 113 (FIG. 17) extending radially inwardly from the inner wall 99 of the band 36. In the example of FIG. 17, there are 4 radially spaced fingers 113 along the inner wall 99 of the band 36.

Figure 16:
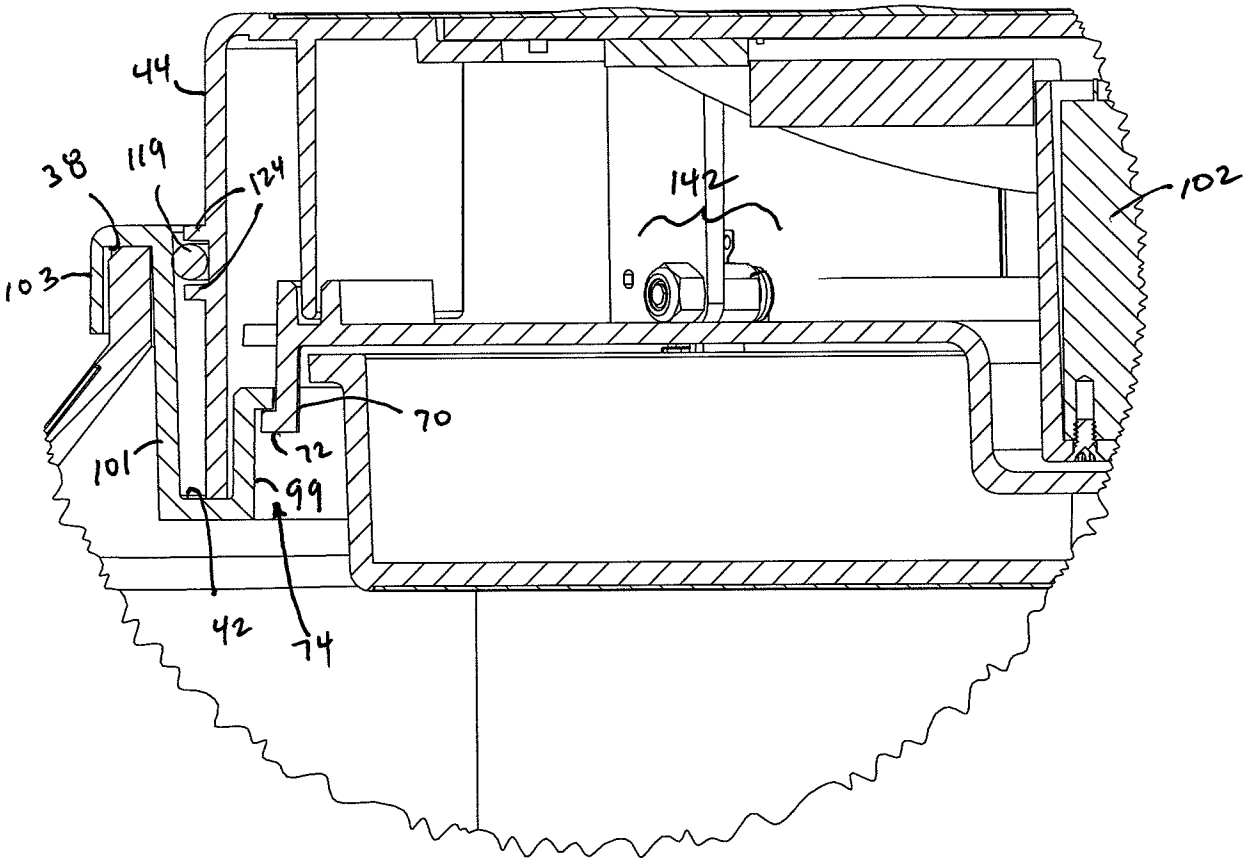
FIG. 16 is an enlarged view of a portion of FIG. 14.

Also visible in FIGS. 15 and 16 is an o-ring seal member 119 held by the outer wall 44 of the lid 46. The seal member 119 forms a removable seal between and against the lid 46 and the band 36 of the canister 22. The seal member 119 is held by seal holder 124 (FIG. 8) in the outer wall 44 of the lid 46.

The lid 46 can include a through hole 48. The lid 46 can hold at least a portion of a lock member 50, described further below, within the hole 48.

In the embodiment of FIGS. 1-5, the lid 46 includes an undulated outer periphery 47 to help enhance grip of the lid 46.

The container 20 further includes a locking ring 52. The locking ring 52 is rotatably and non-removably secured to the lid 46 and is rotatable between a locked position and an unlocked position.

In the locked position, the locking ring 52 is engaged with the ledge 34 to prevent removal of the lid 46 from the canister 22. In the unlocked position, the locking ring 52 is disengaged from the ledge 34 to allow removal of the lid 46 from the canister 22.

In the embodiment of FIG. 2, the locking ring 52 is a circular disk 54 with at least one, and as shown, two radially protruding tabs 56, 58. The tabs 56, 58, in this embodiment, are located about 180° relative to each other. In the center of the disk 54 is a hole or opening 60 to allow for passage of a screw fastener 62. Also visible in FIG. 2 are washers 64, 65 to help secure the fastener 62 in place.

In the embodiment of FIGS. 6-18, the locking ring 52 is an open ring 68. Extending axially below the ring 68 are a plurality of spaced flanges 70. In this embodiment, there are four flanges 70 spaced about 90° apart from each other. Extending radially outwardly from each flange 70 is a tab 72.

The ledge 34 and locking ring 52 are members of a tab and slot arrangement 74 (FIGS. 2 and 15). A first member of the tab and slot arrangement 74 defines one or more protruding tabs, while a second member defines at least a same number of openings/or open slots. Axial movement between the first member and second member is blocked unless the one or more tabs are aligned with the open slots to allow the tabs to pass through the slots.

While many embodiments are possible, in the one shown in the drawings, the locking ring 52 is the first member of the tab and slot arrangement 74, while the ledge 34 is the second member of the tab and slot arrangement 74. In FIG. 2, the locking ring 52 includes the tabs 56, 58, while the ledge 34 defines openings or slots 76 as a gap between the ledge 34. The openings or slots 76 allow for the tabs 56, 58 to pass there through, when the tabs 56, 58 are aligned with the slots 76. Otherwise, the tabs 56, 58 are under the ledge 34, which does not allow for axial motion.

In the embodiment of FIGS. 6-18, the tabs 72 extend from the ring 68. The open slots 76 are defined as gaps in the ledge 34 of the band 36. In the locked position, the tabs 72 are underneath the ledge 34, while in the unlocked position, the tabs 72 are aligned with the openings or slots 76 to allow for axial movement and passage of the tabs 72 through the slots 76. In FIG. 18, it can be seen how the openings or gap between the ledge 34, shown as fingers 113, forms the slots 76 through which the tabs 72 can pass.

As previously mentioned, the container 20 includes lock member 50, which functions as a means for locking 51. The lock member 50 is connected to the locking ring 52 to permit selectively moving the locking ring 52 between the locked position and the unlocked position. The means for locking 51 can be embodied as a cam lock 78 (FIGS. 1-5) or keypad 96 with a circuit board 100 and motor assembly 98 (FIGS. 6-18).

In the embodiment of FIGS. 1-5, the lock member 50 is cam lock 78. Specifically, in the embodiment shown, the cam lock 78 is a tubular key cam lock 80, as is conventional in the art.

The cam lock 78 is non-removably held by the lid 46 in the through hole 48. A nut 82 (FIG. 2) helps to hold the cam lock 78 non-removably and non-rotatably within the lid 48. As can be appreciated by reviewing FIG. 2, the hole 48 is non-circular, and includes a pair of straight sides 84, 85 with rounded ends 86, 87. This perimeter shape of the hole 48 matches an outer perimeter shape of the body 90 of the cam lock 78, and helps to keep it non-rotatably in place in the lid 46. The cam lock 78 projects from a planar outer surface 49 defined by the lid 46.

Figure 4:
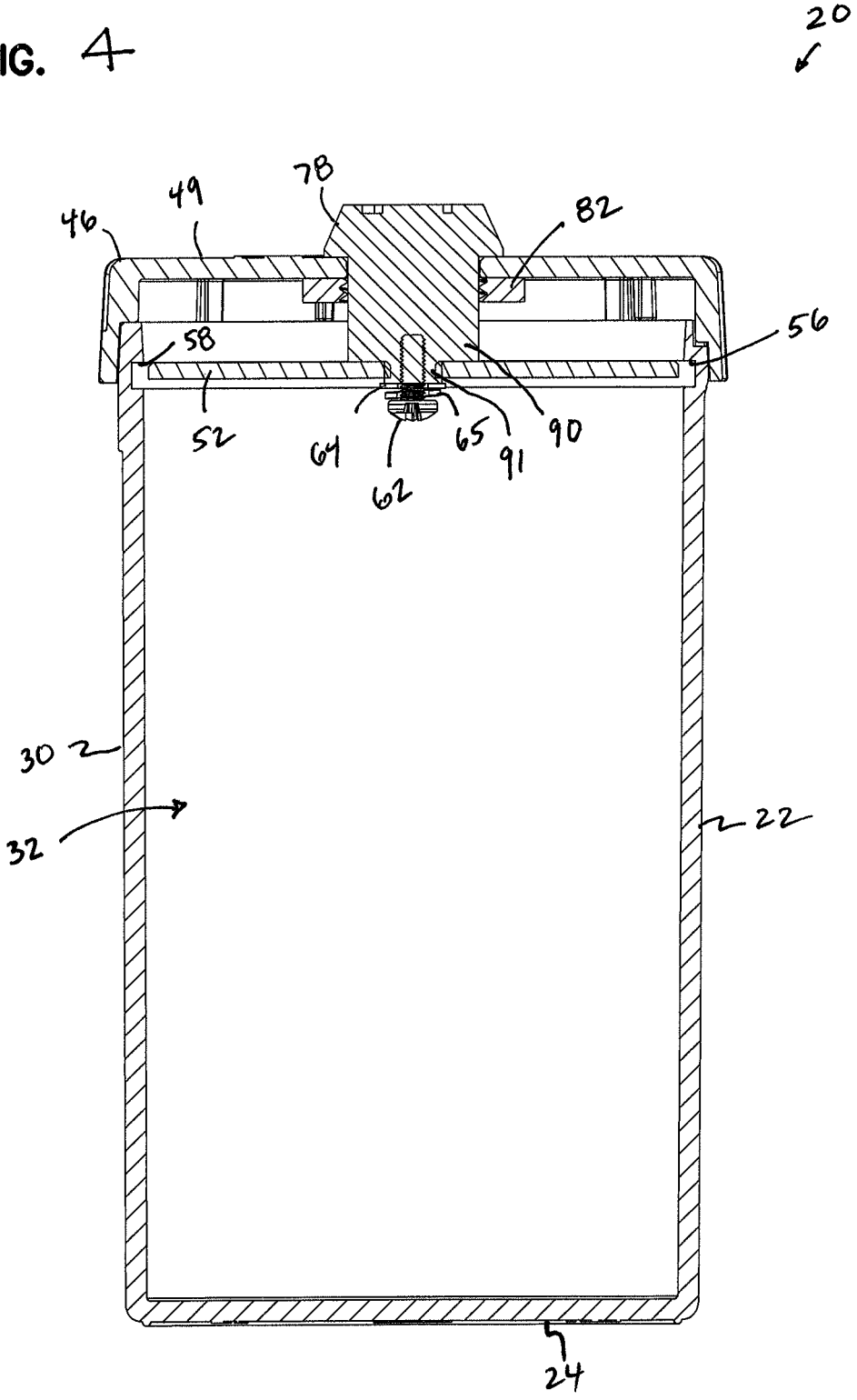
FIG. 4 is a cross-sectional view of the container of FIG. 1, the cross section being taken along the line 4-4 of FIG. 3.

In FIG. 4, it can be seen how the cam lock 78 is secured to the locking ring 52 with the fastener 62. When the cam lock 78 is rotated with an appropriate key, the internal portion 91 of the cam lock body 90 rotates and moves the locking ring 52 rotationally. This will allow movement of the tabs 56, 58 from behind the ledge 34 and into the slots 76. This will then allow for axial separation of the lid assembly 92 from the canister 22.

The lid 46, in the FIG. 1 embodiment, includes a visual feature 93, to assist the user in knowing which way to rotate the lid 46 to its locked or unlocked position. In the embodiment shown, the visual feature 93 is the appearance of a locked and unlocked padlock, with an arrow showing the direction of rotation between the two. Many other alternatives are possible.

Another visual assistance feature for the FIG. 1 embodiment to help the user know the lid 46 is locked are marks 95 (on the lid 46) and 97 (on the canister 22). When the marks 95, 97 are in alignment, the lid 46 is locked on the canister 22. The marks 95, 97 can be a visually distinct color; they can also protrude from the surface to provide a tactile indication to the user.

The lid assembly 92 includes the lid 46, locking ring 52, and lock member 50. The lid assembly 92 is removable from the canister 22 to expose the access opening 28 to allow access to the interior volume 32.

In reference now to the embodiment of FIGS. 6-18, the lock member 50, in this embodiment, includes a keypad 96 with an assembly 98 comprising a circuit board 100 and motor 102. The circuit board 100 is conventional in the art and interacts with the keypad 96 and motor 102.

The motor 102 is energized by a rechargeable battery 104. A USB port 106 (FIGS. 7 and 13) is defined by the container 20 and allows for energizing or recharging of the battery 104 through a USB cable. A pair of screws 107 hold a PCB 105 in communication with the USB port 106. The screws 107 are held in receivers 130 (FIG. 14) that extend from an inner surface of the lid 46.

The keypad 96, by way of the circuit board 100, is programmable through conventional methods so that when a correct key is entered into the keypad 96, the motor assembly 102 rotates the locking ring 52. In the example shown, the motor assembly 102 rotates the hub and spoke assembly 140, which is part of the locking ring 52.

Figure 9:
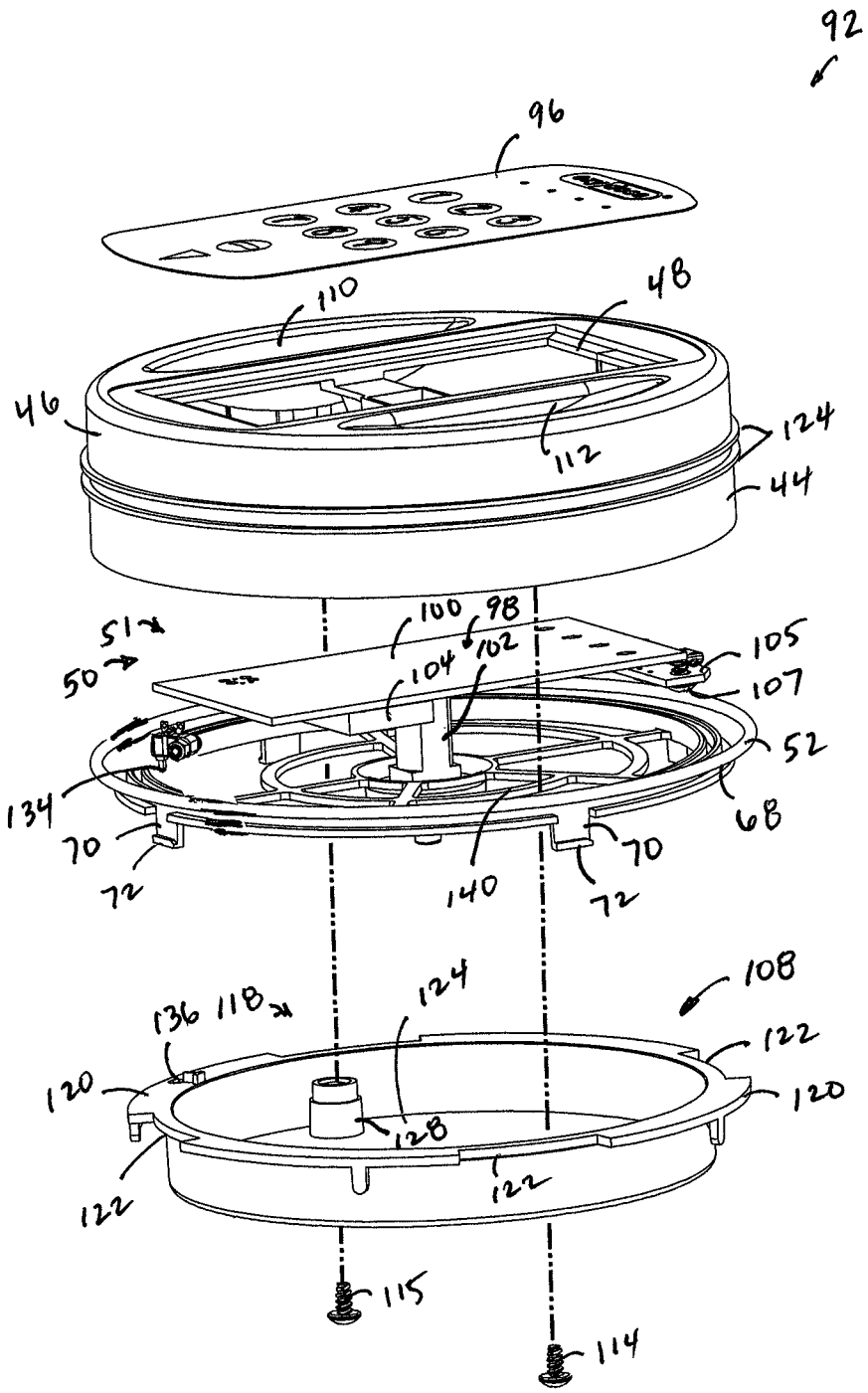
FIG. 9 is an exploded, perspective view of the lid assembly of FIG. 6.
Figure 10:
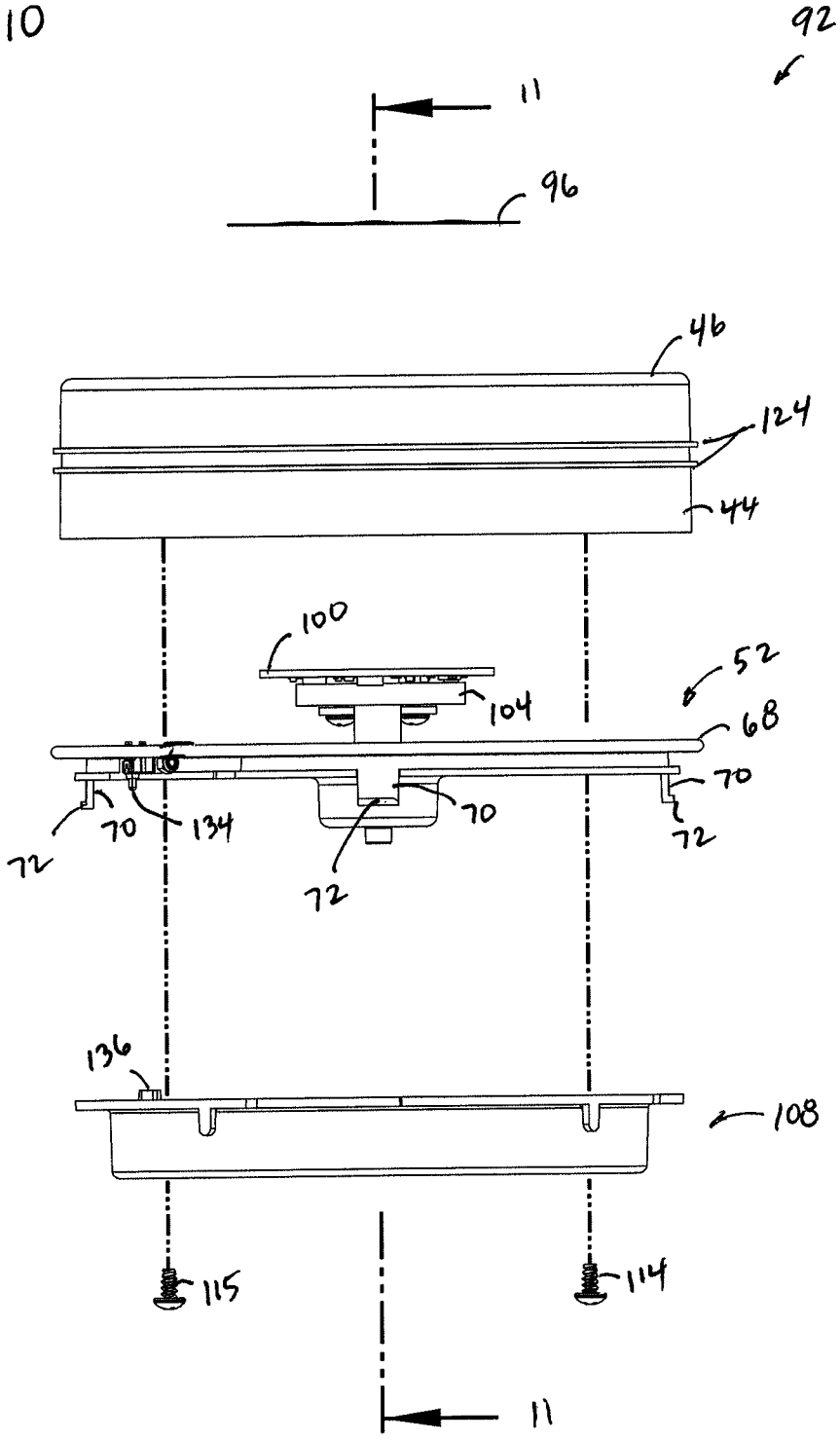
FIG. 10 is a front elevational view of the lid assembly of FIG. 9.
Figure 11:
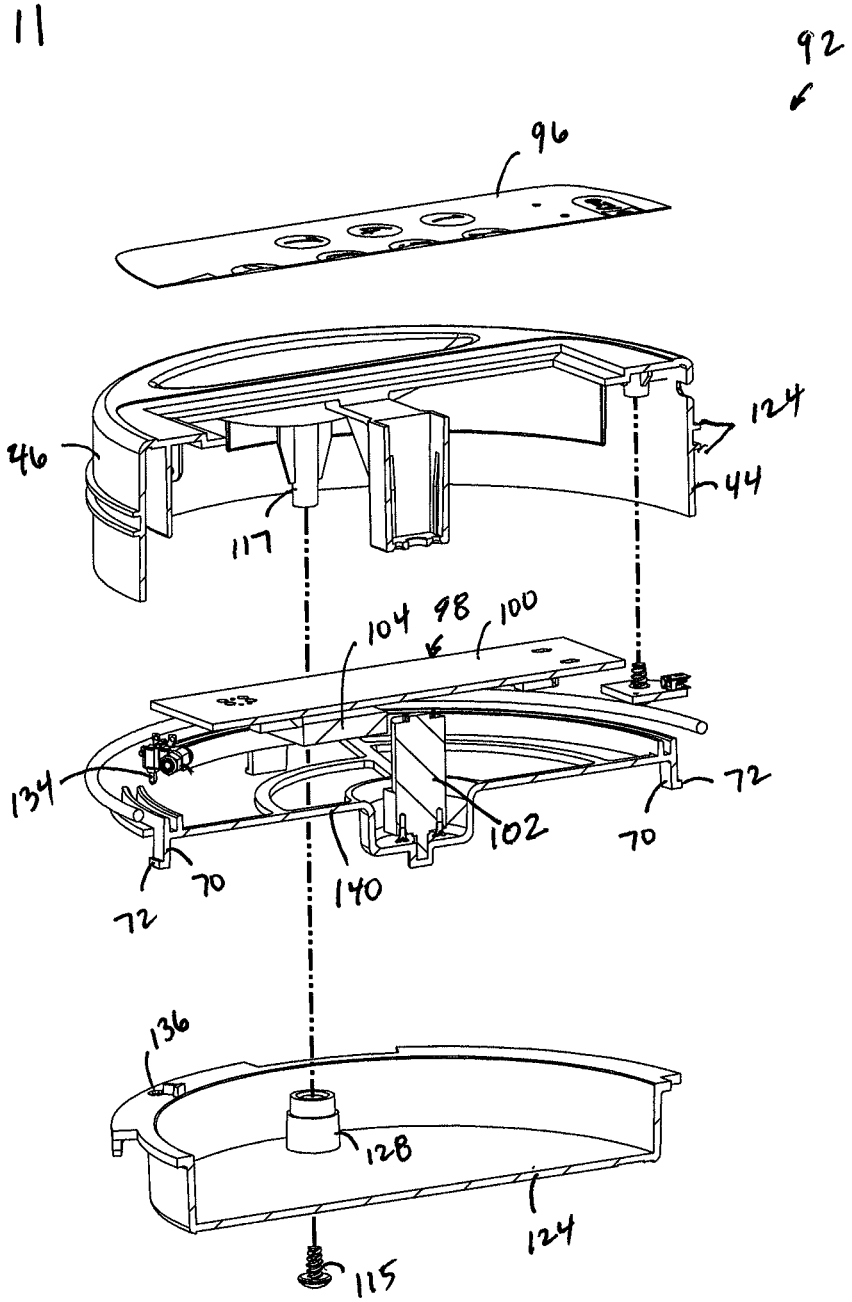
FIG. 11 is a perspective, cross-sectional view of the lid assembly of FIGS. 9 and 10, the cross section being taken along the line 11-11 of FIG. 10.
Figure 12:
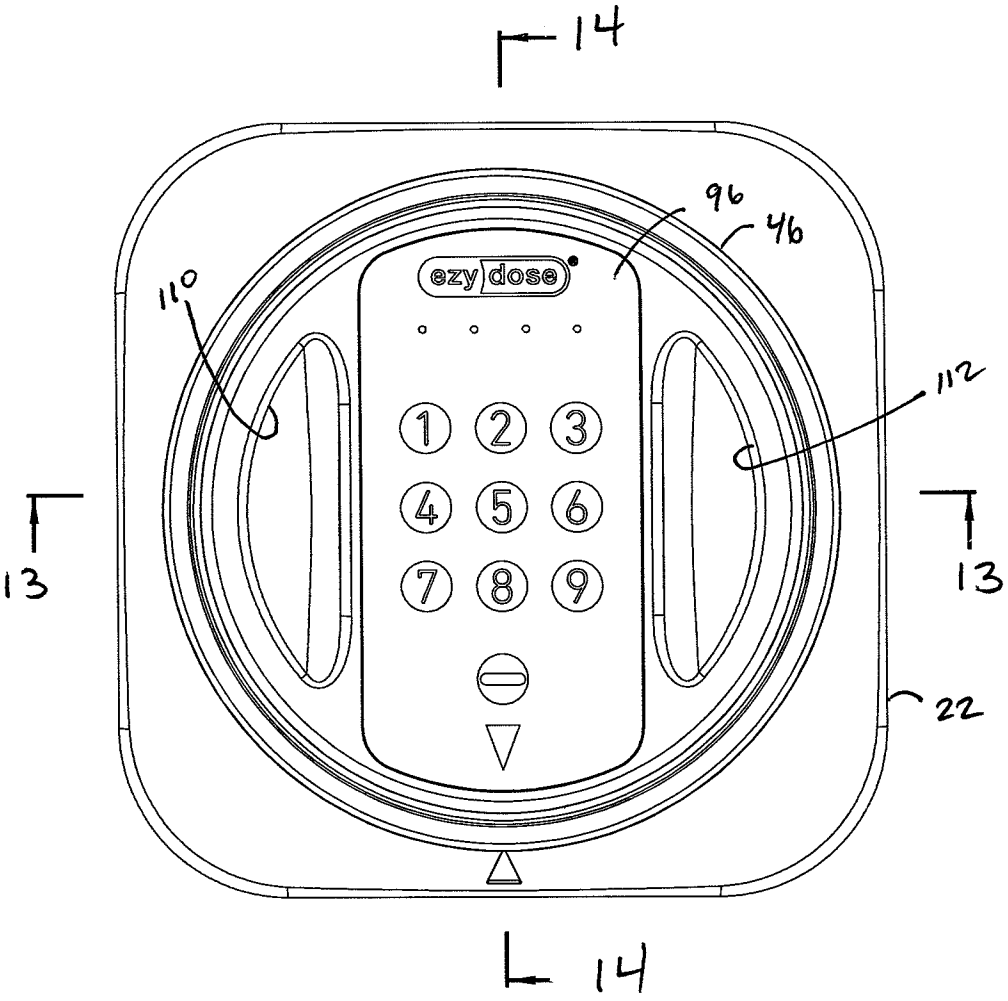
FIG. 12 is a top plan view of the container of FIG. 6.

In FIG. 9, it can also be appreciated that the lid assembly 92 includes a bottom lid assembly 108, which holds assembly 98 including the circuit board 100 and motor 102 between the locking ring 52 and the lid 46. The bottom lid assembly 108 helps to hold all the components within an interior of the lid 46. A pair of fasteners 114, 115 extend through fastener holders 126, 128 (FIG. 13) in a bottom plate 124 and into fastener receivers 116, 117. The fastener receivers 116, 117 extend from an underside of the lid 46.

Still in reference to FIG. 9, the bottom lid assembly 108 includes a rotational motion limiter 118. The rotational motion limiter 118 is embodied as a plurality of circumferentially spaced radial projections 120 separated by a plurality of circumferentially spaced recesses 122. The locking ring 52 will rotate relative to the lid bottom 108 with the flanges 70 and tabs 72 located along the recesses 122 and between the lid bottom projections 120. The lid bottom projections 120 will limit the rotation of the ring 52 because the tabs 72 will engage against the projections 120 of the lid bottom 108.

A microswitch 134 (FIGS. 9-11) is secured to the lid 46 axially in a direction toward the bottom lid assembly 108. In the example shown in FIG. 16, the microswitch 134 is secured to the lid 46 with a nut and bolt assembly 142. The microswitch 134 is received by an opening 136 in one of the lid bottom projections 120 of the bottom lid assembly 108. The microswitch 134 is activated by axial engagement with an axially protruding rib 150 (FIGS. 17 and 18) extending from the inner wall 99 of the band 36, when the lid 46 is in a closed position. As such, the engagement of the microswitch 134 by the rib 150 acknowledges that the lid 46 is operably in place and aligned with the canister 22.

The keypad 96 is held on an exterior portion of the lid 46. In the preferred embodiment shown, the keypad 96 is held within the hole 48 of the lid 46.

In the embodiment of FIGS. 6-18, the lid 46 further includes a pair of finger-engaging recesses 110, 111. The keypad 96 is held in a region in the lid 46 between the recesses 110, 111.

The embodiment of FIGS. 6-18 has advantages. For example, the recesses areas 110, 111 are shaped to allow for comfortable gripping while opening to allow for convenient removal of the lid assembly 92 from the canister 22.

The shape of the canister 22 in the FIG. 6 embodiment allows for convenient storing in either an upright position or on its side. The canister 22 of FIG. 6 has a shape that allows it to be stacked on top of other same-shaped canisters. The bottom end 24 of the canister 22 of the FIG. 6 embodiment also allows for mounting (removable with adhesive or magnets, for example) the container 20 in areas where the user is likely to see and remember to take their medication. For example, the canister 22 can be mounted on the side of a refrigerator, and high enough so that children cannot tamper with the container 20. In addition, the keypad 96 allows for programming or resetting of a code that is easy to remember for the user, as is known in the art.

The embodiment of FIG. 19 is constructed in the same manner as the embodiment of FIGS. 6-18, including the same lid 46, locking ring 52, and lock member 50 with keypad 96, circuit board 100 and motor assembly 102. The shape of the canister 22 of the FIG. 19 embodiment is the only difference from the FIG. 6-18 embodiment, and is one example of many differently shaped canisters that can be used.

The above structure can be used in a method for unlocking a medicine container. The method includes providing canister 22 with access opening 28 and lid 46 removably covering the access opening 28. The lid 46 is non-removably and rotatably secured to the locking ring 52. The method includes rotating the locking ring 52 from a locked position to an unlocked position. The locked position is when the locking ring 52 is engaged with the ledge 34 along a perimeter of the access opening 28 to prevent removal of the lid 46 from the canister 22. The unlocked position is when the locking ring 52 is disengaged from the ledge 34 to allow removal of the lid 46 from the canister 22.

In one embodiment, the step of rotating the locking ring 52 includes rotating the cam lock 78 connected to the locking ring 52. In another embodiment, the step of rotating the locking ring 52 includes using the motor assembly 102 to rotate the locking ring 52. The step of using the motor assembly 102 includes entering a pre-selected code into the keypad 96 connected to the circuit board 100 and the motor assembly 102. The preselected code will actuate the motor assembly 102, which will rotate the locking ring 52. This will move the tabs 72 from the ledge 34 to the slots 76 to allow for the lid assembly 92 to be separated from the canister 22 and expose the access opening 28.

Figure 20:
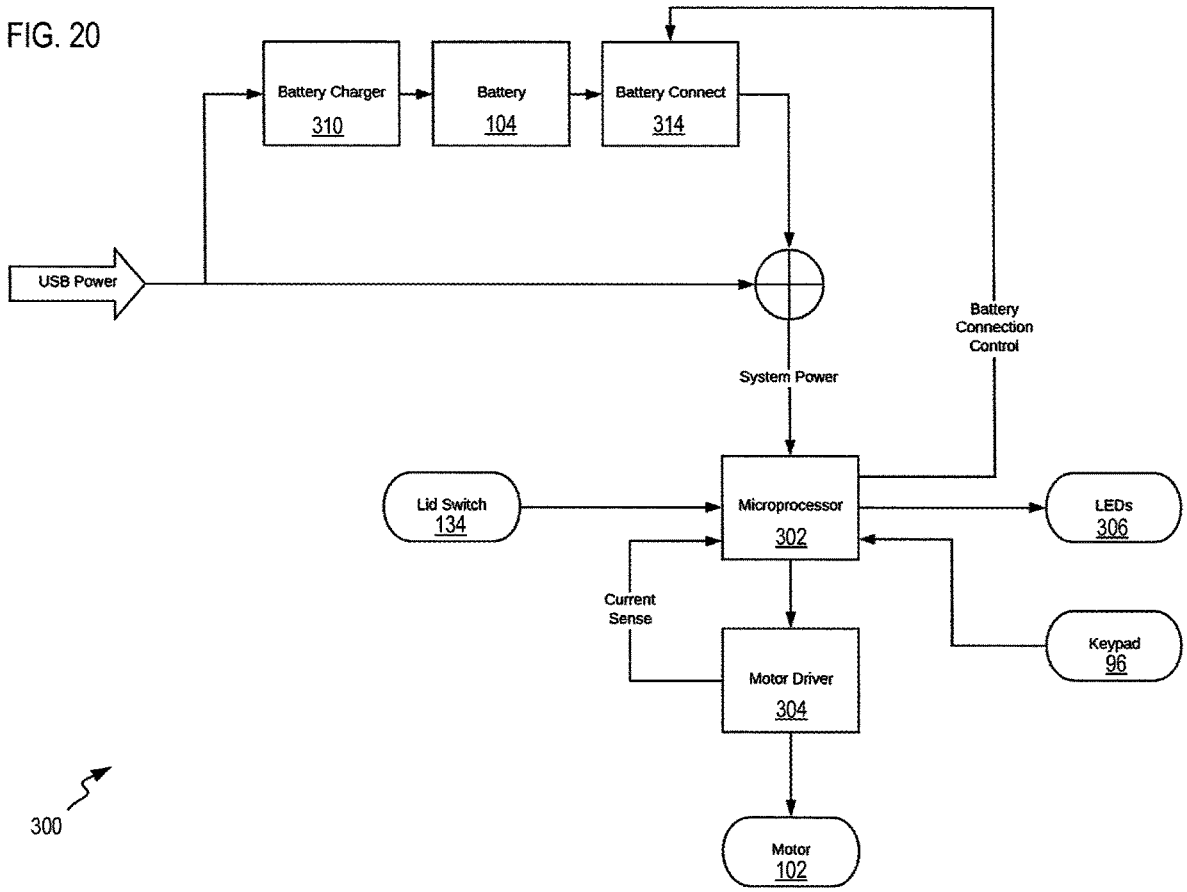
FIG. 20 depicts a block diagram of electronics useable within the lockable medicine container of FIGS. 1-19.
Figure 21:
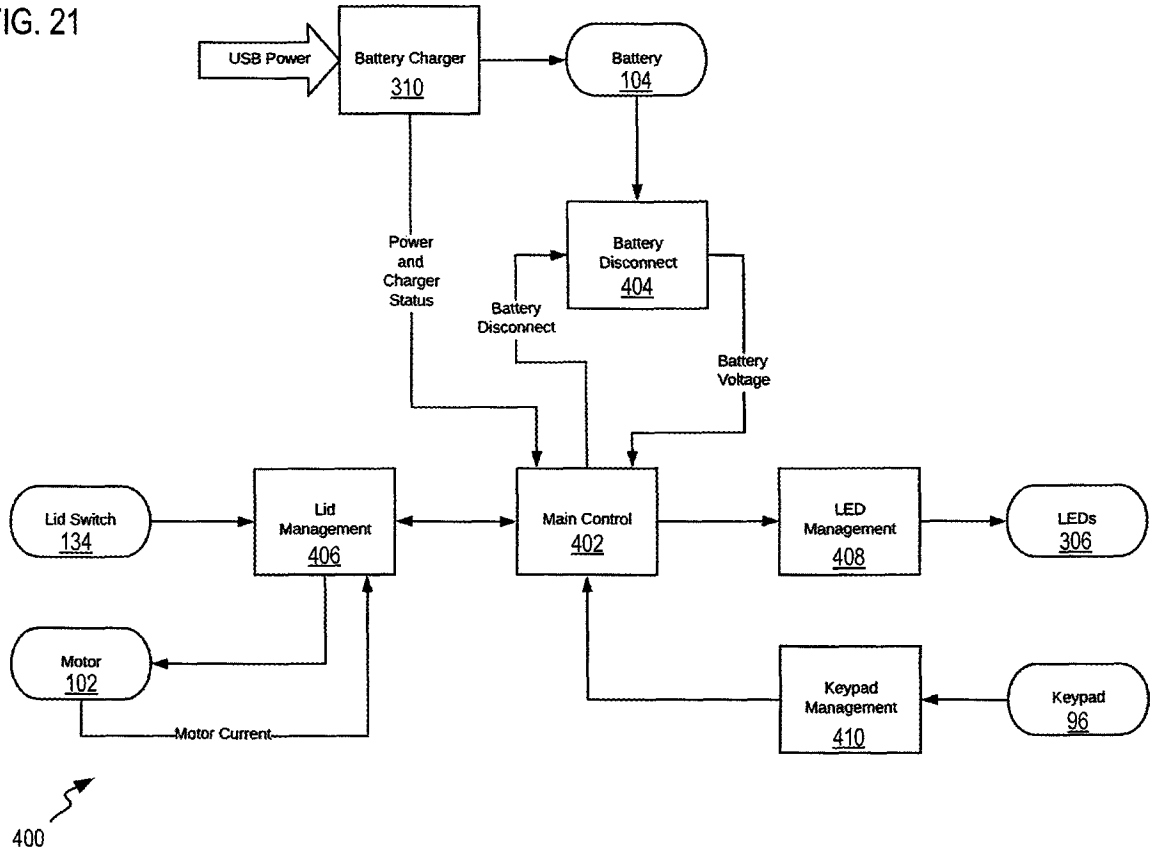
FIG. 21 depicts a functional diagram illustrating operation of the electronics of FIG. 20.

Referring to FIGS. 20-21, details regarding electronics included in the lockable medicine container and operation of those electronics are described. FIG. 20 illustrates electronics 300 which may be mounted on circuit board 100 or circuit board 105, or otherwise included in the lid assembly 92.

In the embodiment shown, the circuitry 300 includes a microprocessor 302 which is communicatively interconnected to the keypad 96, motor 102, and lid switch 134. The microprocessor 302 may be any of a variety of types of programmable circuits, such as FPGA, ASIC, or other microcontroller-based designs. The microprocessor 302 may include a memory that is configured to store instructions which, when executed, cause the microprocessor to receive signals from the keypad 96 and operate the motor 102 and lid switch in accordance with the present disclosure.

In the embodiment shown, the microprocessor 302 is electrically connected to a motor driver 304 which provides a driving electrical signal to the motor 102. The motor driver 304 senses a current from the microprocessor 302, and in response, actuates the motor 102.

The microprocessor 302 is further electrically connected to a USB port 106 as well as a battery 104. In the embodiment shown, the USB port 106 is electrically connected to the battery 104 via a battery charger circuit 310 which controls electrical current provided to the battery 104 (e.g., to manage charging rate of the battery 104). A battery connection circuit 314 is electrically connected between the battery 104 and microprocessor 302, and, based on a battery connection control signal from the microprocessor 302, selectively provides power to the microprocessor 302 from the battery 104. For example, the battery connection circuit 314 may be configured to provide power to the microprocessor 302 (and therefore also to the LEDs 306, keypad 96, motor 102, and lid switch 134) when no power is otherwise being received via the USB port 106 (e.g., when the lockable medicine container is not electrically connected to an external USB cable and associated power source).

Use of the electronics 300 is depicted in the functional diagram 400 of FIG. 21. As seen in the diagram 400, a main control process 402 manages operation of the electronic operations of the lockable medicine container, and in typical embodiments, will be implemented via the microprocessor 302. The main control process 402 will generally manage power, user input/output, and lid management operations via communication with subsidiary control processes, including a battery disconnect process 404, a lid management process 406, and LED management process 408, and a keypad management process 410.

In the example shown, the battery disconnect process 404 cooperates with the main control process 402 to control electrical connection of the battery to the microprocessor. Based on a current battery voltage received from the battery disconnect process 404 and a power and charger status received from the battery charger circuit 310, the main control process 402 can selectively transmit a battery disconnect signal to the battery disconnect process, thereby switching power supply to the electronics 300 between battery and USB power. Accordingly, the main control process 402 cooperates with the battery disconnect process 404 and battery charger circuit 310 to control battery charging and consumption, and may optionally control the electronics 300 to enter a low power state when the lockable medicine container is not in use.

The lid management process 406 can receive commands from the main control process 402 to actuate the lid switch 134 or motor 102. The lid management process 406 receives a motor current from the motor 102 to control speed/status of operation of the motor to actuate the lid. Optionally, the lid management process 406 can be configured to detect a status of the lid (e.g., whether the lid is in place to close the container) and can provide that status back to the main control process 402; in some embodiments, the main control process may responsively actuate the motor 102 via the lid management process 406 to automatically re-lock the lid in place.

The LED management process 408 drives the LEDs 306 in response to a status determined by the main control process 402. The LED management process 408 may, cooperatively with the main control process 402, provide LED-based feedback to a user, e.g., to indicate a startup sequence, or a successful or unsuccessful entry of a PIN code. For example, the LEDs may be programmed to output a green light indicating normal operation, or a red light to indicate an error in entry of such a PIN code, or some other flashing sequence to indicate that the main control process is in a programming state in which a new PIN code may be received at the keypad 96.

The keypad management process 410 detects user input at the keypad 96. The user input at the keypad may cause the main control process 402 to enter a wake-up state and receive key input codes from the keypad, e.g., for purposes of actuating the lid via the lid management process 406, for re-assigning a PIN code stored in memory of the microprocessor 302, or other programming inputs.

The electronics for the medicine container 20 with the electronic locking features described herein can be operated as follows. This is just one example of operation:

Entering an Initial PIN: Plug the device into USB power. All LEDs will light up RED. A 4 digit PIN is entered, followed by the Enter button. As Digits are pressed, RED LEDs will be replaced by GREEN LEDs. After entering 4 Digits and pressing the Enter button, all LEDs will flash GREEN 3 times and then all LEDs will be turned OFF to indicate successful PIN programming. If 5 Digits are pressed, RED LEDs will flash 3 times and then all LEDs will light up RED to indicate an error and that a PIN still needs to be entered.

After the initial PIN is entered, the following may be done. When the lid is off the container: the PIN can be changed by pressing and holding the Enter button will cause the first LED to turn GREEN. After 3 seconds, all the LEDs will flash RED three times and then all LEDs will light up RED to indicate that a new PIN can be entered. Releasing the Enter button before three seconds will cause the first LED to turn OFF. As Digits are pressed, RED LEDs will be replaced by GREEN LEDs. After 4 Digits and the Enter button is pressed, all LEDs will flash GREEN 3 times and then all LEDs will be OFF to indicate successful PIN programming. If 5 Digits are pressed, all LEDs will flash RED 3 times and then all LEDs will light up RED to indicate an error and that a PIN still needs to be entered. If less than 4 Digits are entered and the Enter button is pressed, all LEDs will flash RED 3 times and then all LEDs will light up RED to indicate an error and that a PIN still needs to be entered. If no buttons are pressed for approximately 15 seconds, all LEDs will flash RED 3 times and then all LEDs will be OFF to indicate that a timeout occurred and the PIN was NOT changed. Pressing Digits will do nothing. Putting the Lid ON the container will cause the lid to lock automatically if a PIN is set.

When the lid is on the container: the PIN can be entered to unlock lid. As Digits are pressed, GREEN LEDs will light up one at a time to indicate PIN entry. After 4 Digits and the Enter button is pressed the PIN will be validated. If valid, all LEDs will flash GREEN 3 times and then all LEDs will be OFF, and the Lid will be Unlocked. If invalid, all LEDs will flash RED 3 times and then all LEDs will be OFF to indicate that an incorrect PIN was entered. The Lid will remain locked. If 5 Digits are pressed, all LEDs will flash RED 3 times and then all LEDs will be OFF to indicate that an invalid PIN was entered. The Lid will remain locked. If less than 4 Digits are entered and the Enter button is pressed, all LEDs will flash RED 3 times and then all LEDs will be OFF to indicate that an invalid PIN was entered. The Lid will remain locked. If no buttons are pressed for approximately 15 seconds, all LEDs will flash RED 3 times and then all LEDs will be OFF to indicate that a timeout occurred.

When plugged into USB power and charging, GREEN LEDs will illuminate in a "filling" pattern, once per second as follows: First one LED, then two LEDs, then three LEDs, then four LEDs, repeat. When fully Charged, all LEDs with light up GREEN.

When there is a low Battery, all four RED LEDs will light up for 0.25 seconds, then all OFF for 2.75 seconds.

When there is an Empty Battery, the Processor will disconnect from battery to keep from damaging it due to under voltage condition.

Plugging in to USB power will wake up the processor.

Example system components include the following: The keypad will have keys 1-9, and an enter key. The system will have 4 Red and 4 Green used to indicate various statuses. The system will have a motor used to Lock/unlock the lid. The system will contain a rechargeable battery that will provide a continuous run-time of at least 30 days between charges. The lid switch is a sensor that detects if the container has the Lid on or off. When the lid is inserted into container, it will be automatically locked. In order to save cost, motor current sensing will be used to detect the Lock and Unlock states, rather than limit switches. When lid is removed, programming pass code is possible. When the lid is put on the container, the motor will run to lock. In order to conserve battery, after a few seconds of inactivity, the system will go to sleep. Pressing any key or placing the lid on the container will wake the system up.

The above represents example principles. Many embodiments can be made using these principles.

What is claimed is:

1. A lockable medicine container comprising:

(a) a canister having a closed bottom end, an opposite top end defining an access opening, a surrounding wall between the bottom end and the access opening, and an interior volume within the surrounding wall;

(i) a radially inwardly extending ledge protruding from the surrounding wall along at least a portion of a perimeter of the access opening;

(b) a lid removably covering the access opening on the top end;

(c) a locking ring rotatably and non-removably secured to the lid and being rotatable between a locked position and an unlocked position;

(i) the locked position being when the locking ring is engaged with the ledge to prevent removal of the lid from the canister; and (ii) the unlocked position being when the locking ring is disengaged from the ledge to allow removal of the lid from the canister; and (d) a lock member connected to the locking ring to permit selectively moving the locking ring between the locked position and unlocked position.

2. The container of claim 1 wherein:

the ledge and locking ring are members of a tab and slot arrangement, in which a first member defines one or more protruding tabs and a second member defines at least a same number of open slots as protruding tabs; and axial movement between the first and second member is blocked unless the one or more tabs are aligned with the open slots to allow the tabs to pass through the slots.

3. The container of claim 2 wherein the locking ring is the first member of the tab and slot arrangement, and the ledge is the second member of the tab and slot arrangement.

4. The container of claim 2 wherein the lock member is a cam lock.

5. The container of claim 2 wherein the lock member is a tubular key cam lock.

6. The container of claim 4 wherein the lid has a through hole, and the cam lock is non-removably held by the lid in the through hole.

7. The container of claim 1 wherein the canister is cylinder-shaped.

8. The container of claim 1 wherein the canister includes a band forming the access opening, and the ledge protrudes radially inwardly from the band.

9. The container of claim 2 wherein the lock member includes a keypad with a circuit board and motor assembly, wherein when a correct code is entered into the keypad, the motor assembly rotates the locking ring.

10. The container of claim 9 further including a lid bottom holding the circuit board and motor assembly between the locking ring and the lid.

11. The container of claim 9 wherein the keypad is held on an exterior portion of the lid.

12. The container of claim 9 wherein the lid includes a pair of spaced finger-engaging recesses, and the keypad is held in a region between the recesses.

13. The container of claim 9 wherein the lid has a round cross-section, and the canister has a generally-rectangular cross-section.

14. The container of claim 9 wherein the circuit board and motor assembly includes a rechargeable battery, and the container defines a USB port in communication with the battery.

15. The container of claim 9 wherein the lid has a round cross-section, and the canister has rounded body with flat sides.

16. A lockable medicine container comprising:

(a) a canister having a closed bottom end, an opposite top end defining an access opening, a surrounding wall between the bottom end and the access opening, and an interior volume within the surrounding wall;

(i) a radially inwardly extending ledge protruding from the surrounding wall along at least a portion of a perimeter of the access opening;

(b) a lid removably covering the access opening on the top end;

(c) a locking ring rotatably and non-removably secured to the lid and being rotatable between a locked position and an unlocked position;

(i) the locked position being when the locking ring is engaged with the ledge to prevent removal of the lid from the canister; and (ii) the unlocked position being when the locking ring is disengaged from the ledge to allow removal of the lid from the canister; and (d) a means for locking to selectively move the locking ring between the locked position and unlocked position.

17. The container of claim 16 wherein the means for locking is a cam lock.

18. The container of claim 16 wherein the means for locking is a keypad with a circuit board and motor assembly.

19. The container of claim 16 wherein:

the ledge and locking ring are members of a tab and slot arrangement, in which a first member defines one or more protruding tabs and a second member defines at least a same number of open slots as protruding tabs; and axial movement between the first and second member is blocked unless the one or more tabs are aligned with the open slots to allow the tabs to pass through the slots.

20. A method for unlocking a medicine container; the method comprising:

(a) providing a canister with an access opening and a lid removably covering the access opening; the lid being non-removably and rotatably secured to a locking ring; and (b) rotating the locking ring from a locked position to an unlocked position;

(i) the locked position being when the locking ring is engaged with a ledge extending radially inwardly along a perimeter of the access opening to prevent removal of the lid from the canister; and (ii) the unlocked position being when the locking ring is disengaged from the ledge to allow removal of the lid from the canister.

21. The method of claim 20 wherein the step of rotating the locking ring includes rotating a cam lock connected to the locking ring.

22. The method of claim 20 wherein the step of rotating the locking ring includes using a motor assembly to rotate the locking ring.

23. The method of claim 22 wherein the step of using a motor assembly includes entering a pre-selected code into a keypad connected to a circuit board and the motor assembly.

24. The method of claim 23 further including a step of removing the lid and re-setting the code.

* * * * *